US010016807B2

(12) United States Patent
Tsutsumi et al.

(10) Patent No.: US 10,016,807 B2
(45) Date of Patent: Jul. 10, 2018

(54) CORE MOLDING METHOD AND CORE MOLDING DEVICE

(71) Applicant: Kobe Steel, Ltd., Hyogo (JP)

(72) Inventors: Kazuyuki Tsutsumi, Kobe (JP); Yusaku Takagawa, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 143 days.

(21) Appl. No.: 15/100,798

(22) PCT Filed: Nov. 25, 2014

(86) PCT No.: PCT/JP2014/081082

§ 371 (c)(1),
(2) Date: Jun. 1, 2016

(87) PCT Pub. No.: WO2015/083581

PCT Pub. Date: Jun. 11, 2015

(65) Prior Publication Data

US 2016/0303645 A1 Oct. 20, 2016

(30) Foreign Application Priority Data

Dec. 5, 2013 (JP) ..... 2013-252259
Aug. 25, 2014 (JP) ..... 2014-170154

(51) Int. Cl.

| | |
|---|---|
| ***B22C 9/10*** | (2006.01) |
| ***B22C 13/04*** | (2006.01) |
| ***B22C 13/14*** | (2006.01) |
| ***B22C 7/06*** | (2006.01) |
| ***B22C 1/22*** | (2006.01) |
| ***B22C 9/02*** | (2006.01) |

(Continued)

(52) U.S. Cl.
CPC ..... *B22C 9/10* (2013.01); *B22C 1/10* (2013.01); *B22C 1/22* (2013.01); *B22C 7/06* (2013.01); *B22C 9/02* (2013.01); *B22C 9/12* (2013.01); *B22C 13/04* (2013.01); *B22C 13/14* (2013.01)

(58) Field of Classification Search
CPC .... B22C 1/10; B22C 1/22; B22C 7/06; B22C 9/02; B22C 9/10; B22C 9/12; B22C 13/04; B22C 13/14
See application file for complete search history.

(56) References Cited

U.S. PATENT DOCUMENTS

2008/0021133 A1 1/2008 Furusawa et al.
2015/0231692 A1* 8/2015 Tsutsumi ..... B22C 9/02 164/349

FOREIGN PATENT DOCUMENTS

CN 101569921 A 11/2009
JP 52-147518 A 12/1977
JP 60061143 A * 4/1985

(Continued)

OTHER PUBLICATIONS

International Search Report issued in PCT/JP2014/081082; dated Feb. 17, 2015.

(Continued)

*Primary Examiner* — Kevin E Yoon
(74) *Attorney, Agent, or Firm* — Studebaker & Brackett PC

(57) ABSTRACT

When a core die is being removed from a core while being rotated around its axis, the hardening time of self-hardening sand, the frictional forces generated between the core and the core die during die removal, and the strength of the core during die removal are optimized.

6 Claims, 7 Drawing Sheets

(51) Int. Cl.
*B22C 1/10* (2006.01)
*B22C 9/12* (2006.01)

(56) References Cited

FOREIGN PATENT DOCUMENTS

| | | | | |
|---|---|---|---|---|
| JP | 06-031377 | A | | 2/1994 |
| JP | 2003205345 | A | * | 7/2003 |
| JP | 2004-351446 | A | | 12/2004 |
| JP | 2006-255782 | A | | 9/2006 |

OTHER PUBLICATIONS

Written Opinion issued in PCT/JP2014/081082; dated Feb. 17, 2015.

* cited by examiner

FG. 3

CORE MOLDING METHOD AND CORE MOLDING DEVICE

TECHNICAL FIELD

The present invention relates to a core molding method and a core molding device for molding, using a core die, a complex-shaped core (sand mold) used for casting a product having a helical shape, such as a male rotor or a female rotor of a screw compressor.

BACKGROUND ART

Products having helical shapes such as a male rotor or a female rotor of a screw compressor are usually manufactured by, for example, cutting a cylindrical member and then processing a portion of the cylindrical member into a helical shape using a tool specially designed for processing. Such a manufacturing method, however, is disadvantageous in that it requires a wide process margin and a long processing time. A method known to date for reducing a processing time is a method including forming a near-net-shape cast product (replicating the shape to that of a final product by reducing a process margin) and performing a finishing operation on the cast product.

In some cases, a core die used for molding a core having a helical shape and required for casting a near-net-shape object has a portion protruding perpendicularly to the direction in which the core die is removed from the core (for example, an axial direction or radial direction). In such cases, removal of the core die from the core is difficult unless the core die or the core is deformed.

Thus, PTL 1 discloses a method for casting a multiple-threaded component by dividing a core die into, for example, two core-die sections and molding core sections using the respective core-die sections so that the core-die sections can be easily removed from the core sections. Each of the core-die sections includes a screw portion including a crest-diameter portion and a groove gradient portion. The crest-diameter portion is disposed at the crest of a screw thread so that the outer diameter of the screw thread is substantially uniform with respect to the axis serving as a center. The groove gradient portion is disposed in a thread groove and has a predetermined removal gradient with respect to the axis serving as a center. When a rotational force is applied to the core-die sections while the core-die sections are pulled in one axial direction, the crest-diameter portion of each core-die section slides over the groove portion of the corresponding core section to serve as a guide, so that the core-die sections are easily removed from the core sections.

CITATION LIST

Patent Literature

PTL 1: Japanese Unexamined Patent Application Publication No. 2004-351446

SUMMARY OF INVENTION

Technical Problem

The method in PTL 1, however, requires a wide process margin to allow for a removal gradient disposed with respect to the axis of the thread groove serving as a center or to allow for misalignment at the die matching by introducing sectioned surfaces in the axial direction. This wide processing margin impedes near net shape casting of an object.

If a core die does not have a removal gradient or a sectioned surface, the contact area over which the core die and the core touch each other increases, whereby a frictional force during die removal increases. This increase of the frictional force is assumed to render removal of the core die from the core difficult.

In self-hardening sand widely used as a typical material of a core, a resin serving as a bond required for coupling sand grains together and a hardener serving as a hardening catalyst cause an irreversible dehydration condensation reaction, so that the self-hardening sand hardens and contracts over time. After the self-hardening sand hardens and contracts, the frictional force during die removal increases further, and this further increase of the frictional force is assumed to render the removal of the core die more difficult.

In order to use a core as a mold for casting, the core has to be preserved from collapsing during removal of the core die.

An object of the present invention is to provide a core molding method and a core molding device that enable a reduction of a process margin of a cast product and forming of a near-net-shape cast product.

Solution to Problem

A core molding method according to the invention is a core molding method for molding a core having a helical shape using a core die. The method includes a hardening step in which the core die is disposed in a frame and then self-hardening sand acquired by mixing sand, a resin, and a hardener is filled into the frame and left to harden, and a die removal step in which the core die is removed from the core, resulting from hardening of the self-hardening sand, while being rotated around an axis of the core die. In the die removal step, a time for hardening the self-hardening sand, a frictional force exerted between the core and the core die during die removal, and strength of the core during die removal are optimized.

A core molding device according to the invention is a core molding device that performs the above-described core molding method, the device including the frame in which the core die is disposed and into which the self-hardening sand is filled, and a rotary driving device that rotates the core die around the axis of the core die to remove the core die from the core resulting from hardening of the self-hardening sand.

Advantageous Effects of Invention

According to the core molding method of the present invention, in the die removal step, a time for hardening the self-hardening sand, a frictional force exerted between the core and the core die during die removal, and strength of the core during die removal are optimized. If the time for hardening the self-hardening sand is too short, the strength of the core during die removal is insufficient and the core collapses during die removal. If, on the other hand, the time for hardening the self-hardening sand is excessively long, the frictional force exerted between the core and the core die during die removal is too large and the core die fails to be removed from the core. Thus, the time for hardening the self-hardening sand, the frictional force exerted between the core and the core die during die removal, and the strength of the core during die removal are optimized, so that the core die is allowed to be removed from the core while being rotated around its axis without collapsing the core. Thus, an integral core is allowed to be molded using a core die without any removal gradient or sectioned surface. Thus, the process margin of a cast product can be reduced, whereby the cast product can be formed by near net shape casting. Here, the time for hardening the self-hardening sand is a time elapsed after the completion of mixing of the sand, the resin, and the hardener.

In the core molding device according to the invention, the core die is rotated around its axis by the rotary driving device. When the core die is manually rotated, the axis of the core die is more likely to be inclined and the stress per unit area or the removal torque is more likely to change, whereby stably molding the core is rendered difficult. To address this, the core die is rotated by the rotary driving device, so that the axis of the core die is prevented from being inclined. Thus, the stress per unit area or the removal torque is rendered stable, so that the core die is allowed to be stably removed from the core.

DESCRIPTION OF EMBODIMENTS

Figure 1:
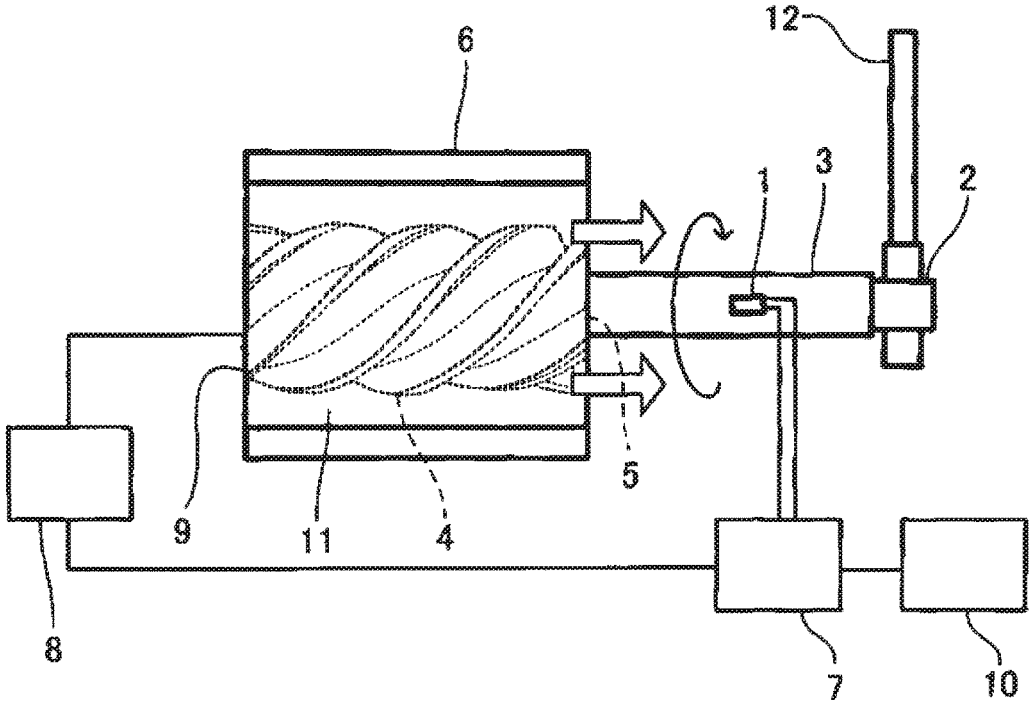
FIG. 1 illustrates a configuration at a die removal test.

Referring now to the drawings, embodiments of the present invention are described below.

First Embodiment

Core Molding Method

A core molding method according to a first embodiment of the present invention is a method for molding, using a core die, a complex-shaped core (sand mold) required for casting a product having a helical shape such as a male rotor or a female rotor of a screw compressor. This core molding method includes a hardening step and a die removal step.

Hardening Step

The hardening step is a step in which a core die is disposed inside a frame, and self-hardening sand, obtained by mixing sand, a resin, and a hardener is filled into the frame and left to harden. Sand used as the self-hardening sand is new sand or reclaimed sand having polygonal or spherical grains whose size is 130 AFS (American Foundry Society) or smaller. The resin included in the self-hardening sand to serve as a bond is an acid-setting furan resin containing furfuryl alcohol. The content of the resin with respect to the sand is 0.8%. The hardener included in the self-hardening sand to serve as a hardening catalyst is a hardener designed for a furan resin and obtained by mixing a xylene-sulfonic-acid-based hardener and a sulfuric-acid-based hardener. The content of the hardener with respect to the furan resin is 40%. The use of such sand, a resin, and a hardener in the self-hardening sand enables appropriate molding of a core.

In the step of mixing the sand, the resin, and the hardener, preferably, the sand and the hardener are mixed first, then the resin is added to the mixture, and the resin and the mixture are mixed further. A widely-used household mixer is preferably used for this mixing. The sand and the hardener are mixed for 45 seconds by a household mixer, the resin is then added to the mixture, and the resin and the mixture are mixed for another 45 seconds to form self-hardening sand. The resultant self-hardening sand is filled into a wooden frame in which a metal-made core die having a helical shape is disposed. At this time, the self-hardening sand is filled into the frame in the axial direction of the core die while the self-hardening sand is shaken. The resin and the hardener cause an irreversible dehydration condensation reaction, so that the self-hardening sand hardens and contracts over time.

Die Removal Step

The die removal step is a step in which the core die is rotated around its axis so as to be removed from the core resulting from hardening of the self-hardening sand. After an elapse of a predetermined hardening time, an end portion of the core die is held by a tool such as a wrench and the core die is removed from the core while being rotated around its axis. Here, the hardening time indicates a time that has elapsed after the completion of the mixing of the sand, the resin, and the hardener.

If the time for hardening the self-hardening sand is too short, the core collapses during die removal due to insufficient strength of the core during die removal. On the other hand, if the time for hardening the self-hardening sand is too long, the core die fails to be removed from the core due to an excessively large frictional force exerted between the core and the core die during die removal. Thus, the time for hardening the self-hardening sand, the frictional force exerted between the core and the core die during die removal, and the strength of the core during die removal are optimized for removal of the core die from the core.

Specifically, as a frictional force exerted between the core and the core die during die removal, a moment M corresponding to the torque and resulting from the friction between the core and the core die during die removal is optimized. The core die is removed from the core while the moment M is maintained so as to satisfy the relationship of Formula (1), below:

$$0<M=k\sigma\pi D^2L/2\leq T_{max} \qquad \text{Formula (1).}$$

Here, k denotes a friction coefficient, D denotes the diameter of a cylinder having a contact area equivalent to the contact area over which the core die and the core touch each other, L denotes the length of the cylinder, σ denotes the stress per unit area produced in the core, and $T_{max}$ denotes the maximum torque produced during die removal when the core die is removable from the core.

If the moment M exceeds the maximum torque $T_{max}$ that occurs during die removal when the core die is removable from the core, the core die becomes unrotatable and fails to be removed from the core. To address this, the core die is rotated around its axis while the moment M is maintained so as not to exceed the maximum torque $T_{max}$, whereby the core die is rendered removable from the core.

The stress σ (frictional force) per unit area produced in the core during die removal is optimized as the strength of the core during die removal. The core die is removed from the core while the stress σ per unit area produced in the core during die removal is maintained so as to satisfy the relationship of Formula (2), below:

$$0<\sigma=2hT_{max}/\pi D^2L\leq\sigma_{min} \quad \text{Formula (2).}$$

Here, h denotes a coefficient, $T_{max}$ denotes the maximum torque produced during die removal when the core die is removable from the core, D denotes the diameter of a cylinder having a contact area equivalent to the contact area over which the core die and the core touch each other, L denotes the length of the cylinder, and $\sigma_{min}$ denotes the minimum compression strength of the core during die removal.

When the stress σ per unit area produced in the core during die removal exceeds the minimum compression strength $\sigma_{min}$ of the core during die removal, the core causes a collapse. Thus, the core die is rotated around its axis while the stress σ is maintained so as not to exceed the minimum compression strength $\sigma_{min}$, so that the core die is rendered removable from the core without collapsing the core.

As described above, the core die is allowed to be removed from the core while being rotated around its axis without collapsing the core by optimizing, for removal of the core die from the core, the time for hardening the self-hardening sand, the frictional force exerted between the core and the core die during die removal, and the strength of the core during die removal. Thus, an integral core can be molded using a core die without any removal gradient or sectioned surface. Thus, the process margin of the cast product can be reduced and the cast product can be formed by near net shape casting.

Die Removal Test

A die removal test was conducted on a configuration illustrated in FIG. 1 in order to optimize the frictional force exerted between the core and the core die during die removal. An aluminum die for a screw female rotor having a blade diameter of 120 mm and a length of 240 mm was used as a core die 4 having a helical shape without any removal gradient or sectioned surface. An aluminum round bar 3 was attached to a screw portion 5 of the core die 4. The round bar 3 had a flat thinned portion 2 at an end portion. A strain gauge 1 is attached to the round bar 3.

Sand used as the self-hardening sand includes reclaimed sand with a grain size of 36.5 AFS and artificial sand (ESPEARL #25L with a grain size of 24.5 AFS and ESPEARL #100L with a grain size of 111.6 AFS from Yamakawa Sangyo Co., Ltd.), the reclaimed sand and the artificial sand having polygonal or spherical grains. As an example of a resin included in the self-hardening sand, EF-5302 from Kao-Quaker Company, Limited, which is a furan resin, was used and the content of the resin with respect to the sand was determined to be 0.8%. As an example of a hardener included in the self-hardening sand, a mixture of TK-1 and C-21 from Kao-Quaker Company, Limited, at a ratio of 3 to 1 was used, TK-1 and C-21 being hardeners in each of which a xylene-sulfonic-acid-based hardener and a sulfuric-acid-based hardener are mixed. The content of the hardener with respect to the furan resin was determined to be 40%. The sand and the hardener were mixed for 45 seconds using a widely-used household mixer, the resin was then added to the mixture, and the resin and the mixture were mixed for another 45 seconds to form self-hardening sand. The core die 4 was disposed in a wooden frame 6 and the self-hardening sand was filled into the wooden frame 6 in the axial direction of the core die 4 while the self-hardening sand was shaken by a hammer hitting each side of the wooden frame 6. Here, each side of the wooden frame 6 was hit by the hammer ten times.

After an elapse of a predetermined hardening time, the wooden frame 6 was horizontally placed and fixed to the floor with a jig and the strain gauge 1 was wired to a data logger 7. A contact or noncontact displacement meter 8 was attached to an end surface 9 of the core die 4 and wired to the data logger 7. The thinned portion 2 of the round bar 3 was pinched with a wrench 12 and the core die 4 was twisted to be removed from a core 11. The twisting strain caused at this time was measured by the strain gauge 1 and converted into the torque by a personal computer 10 connected to the data logger 7. The displacement caused at the removal of the core die 4 from the core 11 was measured by the displacement meter 8.

Here, the twisting strain was converted into torque T with Formula (3), below:

$$T=\varepsilon EZ/(1+\upsilon) \quad \text{Formula (3).}$$

Here, ε denotes a measured value of the twisting strain, E denotes the Young's modulus of the round bar 3, Z denotes a polar section modulus of the section of the round bar 3, and υ denotes the Poisson's ratio of the round bar 3.

Figure 2:
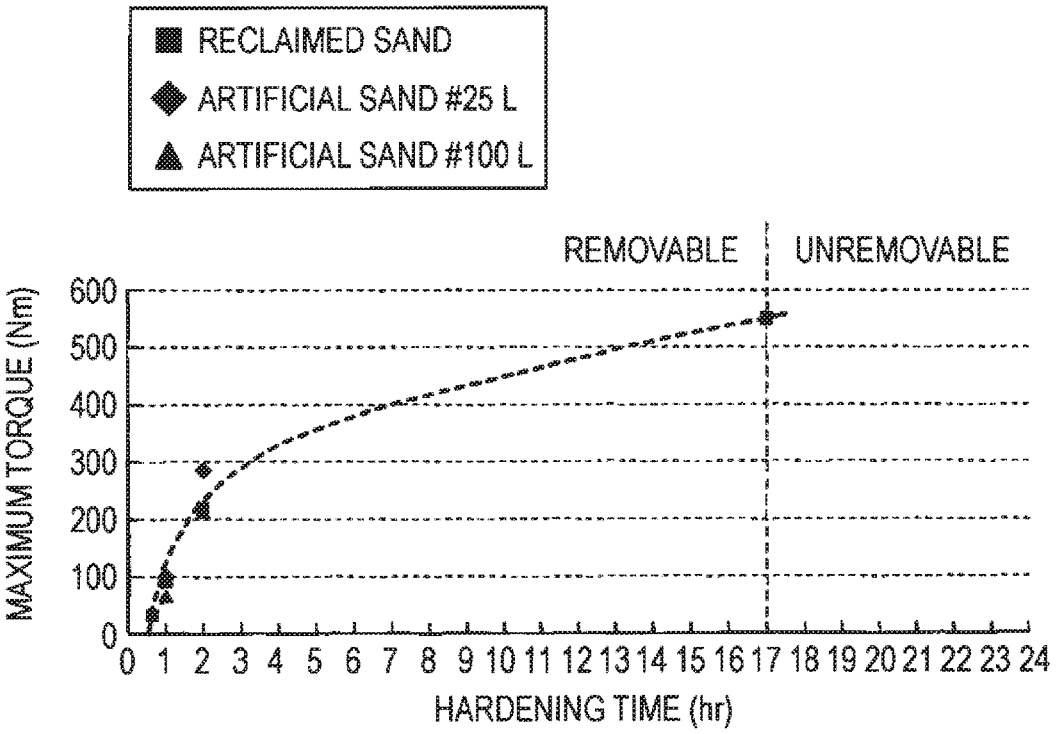
FIG. 2 illustrates a relationship between the hardening time and the maximum torque.

FIG. 2 illustrates the relationship between the hardening time and the maximum torque acquired from the die removal test. Here, the hardening time indicates a time that has elapsed after the completion of mixing of the sand, the resin, and the hardener. At a hardening time of 17 hr, the core die 4 failed to be removed from the core 11 at the point at which the core die 4 was pulled out of the core 11 by only approximately 13 mm. Thus, the maximum torque was calculated from the maximum strain up to the unfinished point. As described above, the core die 4 failed to be removed from the core 11 when the hardening time was determined to be 17 hr. Thus, it was found that the torque has to be smaller than or equal to $5.5\times10^2$ Nm in order to render the core die 4 removable from the core 11.

Compression Test

Subsequently, a compression test was conducted to optimize the strength of the core during die removal. A test piece composed of self-hardening sand and having a diameter of 30 mm and a length of 60 mm was used and the load on and the displacement of the test piece were measured by an Instron universal tester with 50 kN at a strain rate of $2.8\times10^{-3}$/sec.

Figure 3:
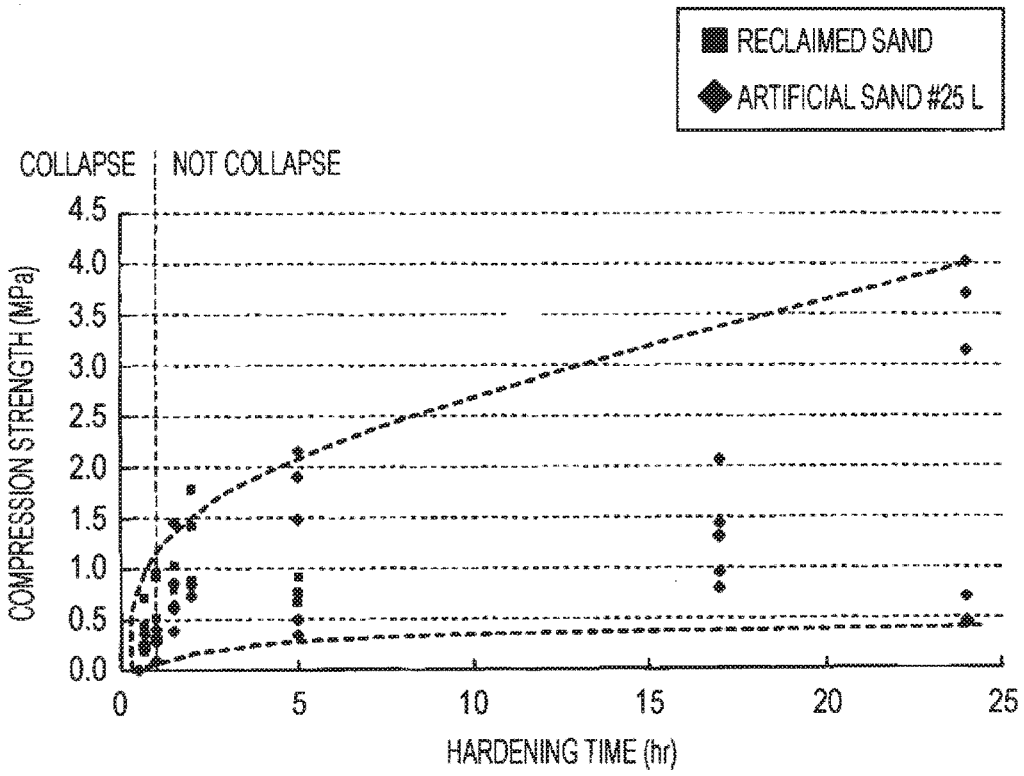
FIG. 3 illustrates a relationship between the hardening time and the compression strength.

FIG. 3 illustrates the relationship between the hardening time and the compression strength acquired from the compression test. At a hardening time of 0.67 hr, the self-hardening sand collapsed and failed to be soundly molded. Thus, it was found that the compression strength has to be higher than or equal to 0.1 MPa in order to render the core die removable from the core while keeping the shape of the core (without causing a collapse of the core).

Study

It is assumed here that the frictional force exerted between the core and the core die during die removal is attributable to the tightening force resulting from hardening of the self-hardening sand and that the tightening force is uniformly exerted over the entire area of the surface of the core die that comes into contact with the core. When the surface area of the core die is denoted by Ar and the stress per unit area produced in the core is denoted by σ, the tightening force of the core is estimated by σAr. The frictional force exerted between the core and the core die during die removal resulting from this tightening force σAr is kσAr, which is the tightening force σAr multiplied by the friction coefficient k. For simplicity, the core die is substituted by a cylinder having a surface area equivalent to the surface area Ar of the core die, the diameter of the cylinder is denoted by D, and the length of the cylinder is denoted by L. Here, the surface area Ar=πDL. Thus, the moment M corresponding to the torque and resulting from the friction between the core and the core die during die removal is expressed as Formula (4):

$$M=k\sigma\pi D^2L/2 \quad \text{Formula (4).}$$

Figure 4:
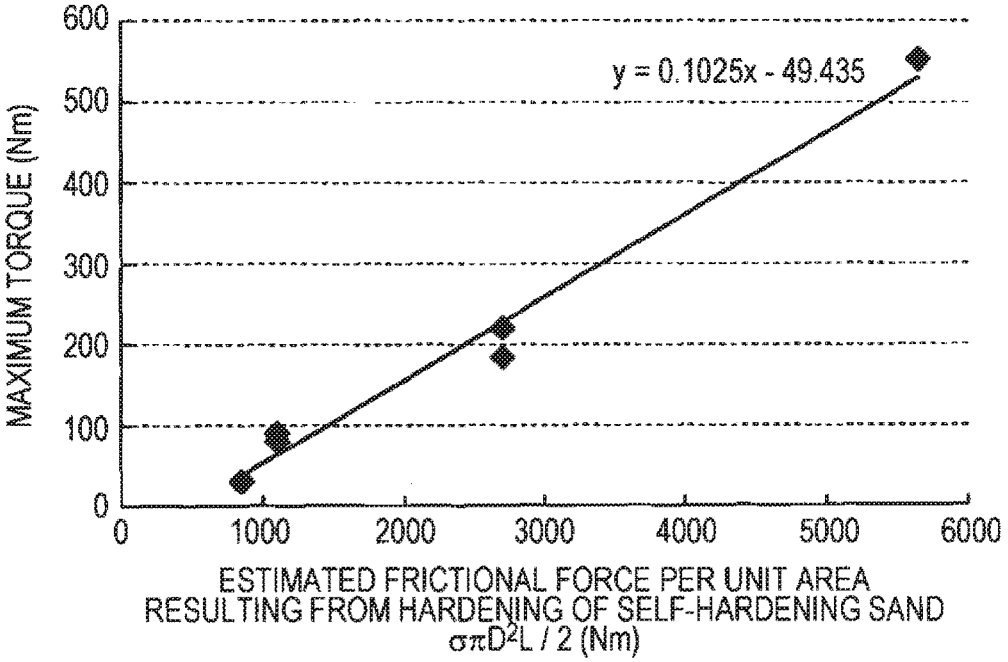
FIG. 4 illustrates a relationship between the maximum torque and the estimated frictional force per unit area resulting from hardening of self-hardening sand.

FIG. 4 illustrates the relationship between the maximum torque and the estimated frictional force per unit area resulting from the hardening of the self-hardening sand. From FIG. 4, the friction coefficient k was determined as 0.04.

When the moment M exceeds the maximum torque $T_{max}$ produced during die removal when the core die is removable from the core, the core die becomes unrotatable, so that the core die fails to be removed from the core. Thus, Formula (5) holds true:

$$0<M\leq T_{max} \quad \text{Formula (5).}$$

Substituting Formula (4) into Formula (5) results in Formula (1). From Formula (1), whether the core die is removable can be determined.

The frictional force exerted between the core and the core die holds the key to removing the core die from the core without collapsing the core. For simplicity, the core die is substituted by a cylinder having a surface area equivalent to the surface area Ar of the core die, the diameter of the cylinder is denoted by D, and the length of the cylinder is denoted by L. Here, the surface area Ar=πDL. The maximum torque produced during die removal when the core die is removable from the core is denoted by $T_{max}$ and the coefficient is denoted by h. Here, the frictional force exerted between the core and the core die due to the rotation of the core die is $hT_{max}/(D/2)$. Thus, the frictional force (stress) σ per unit area produced in the core during die removal is expressed as Formula (6):

$$\sigma=2hT_{max}/\pi D^2L \quad \text{Formula (6).}$$

Figure 5:
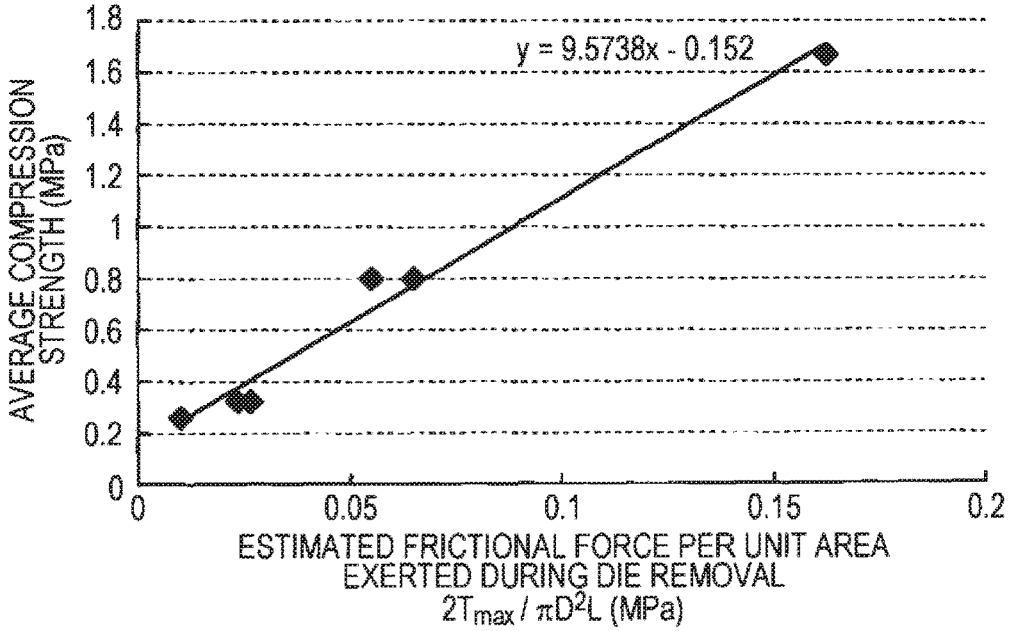
FIG. 5 illustrates a relationship between the average compression strength and the estimated frictional force per unit area that occurs during die removal.

FIG. 5 illustrates the relationship between the average compression strength and the estimated frictional force per unit area exerted during die removal. From FIG. 5, the coefficient h was determined as 26.5. When the frictional force (stress) σ per unit area produced in the core during die removal exceeds the minimum compression strength $\sigma_{min}$ of the core during die removal, the core causes a collapse. Thus, Formula (7) holds true:

$$0<\sigma\leq\sigma_{min} \quad \text{Formula (7).}$$

Substituting Formula (6) into Formula (7) results in Formula (2). From Formula (2), whether the core die is removable from the core without collapsing the core can be determined.

Effects

As described above, the core molding method according to the embodiment includes a die removal step of removing the core die from the core, in which the time for hardening the self-hardening sand, the frictional force exerted between the core and the core die during die removal, and the strength of the core during die removal are optimized. If the time for hardening the self-hardening sand is too short, the strength of the core during die removal is insufficient, so that the core collapses during die removal. On the other hand, if the time for hardening the self-hardening sand is too long, the frictional force exerted between the core and the core die during die removal becomes excessively large, so that the core die becomes unremovable from the core. Thus, the time for hardening the self-hardening sand, the frictional force exerted between the core and the core die during die removal, and the strength of the core during die removal are optimized, so that the core die is allowed to be removed from the core while being rotated around its axis without collapsing the core. An integral core can thus be molded using a core die without any removal gradient or sectioned surface. Thus, the process margin of the cast product can be reduced and the cast product can be formed by near net shape casting.

In addition, the core die is removed from the core while the moment M corresponding to the torque and resulting from the friction between the core and the core die during die removal is maintained so as to satisfy the relationship of Formula (1). If the moment M resulting from the friction between the core and the core die during die removal exceeds the maximum torque $T_{max}$ exerted during die removal when the core die is removable from the core, the core die becomes unrotatable and thus the core die fails to be removed from the core. Thus, the core die is rotated around its axis while the moment M is maintained so as not to exceed the maximum torque $T_{max}$, whereby the core die is rendered removable from the core.

In addition, the core die is removed from the core while the stress σ per unit area produced in the core during die removal is maintained so as to satisfy the relationship of Formula (2). If the stress σ per unit area produced in the core during die removal exceeds the minimum compression strength stress $\sigma_{min}$ of the core during die removal, the core causes a collapse. Thus, the core die is rotated around its axis while the stress σ is maintained so as not to exceed the minimum compression strength $\sigma_{min}$, whereby the core die is rendered removable from the core without collapsing the core.

The core is preferably molded by using, as the self-hardening sand, new sand or reclaimed sand having polygonal or spherical grains whose size is 130 AFS or smaller.

The core is also preferably molded by adding an acid-setting furan resin containing furfuryl alcohol in an amount of 0.8% with respect to the sand.

The core is also preferably molded by adding a hardener obtained by mixing a xylene-sulfonic-acid-based hardener and a sulfuric-acid-based hardener in an amount of 40% with respect to the furan resin.

Second Embodiment

Core Molding Device

Figure 6:
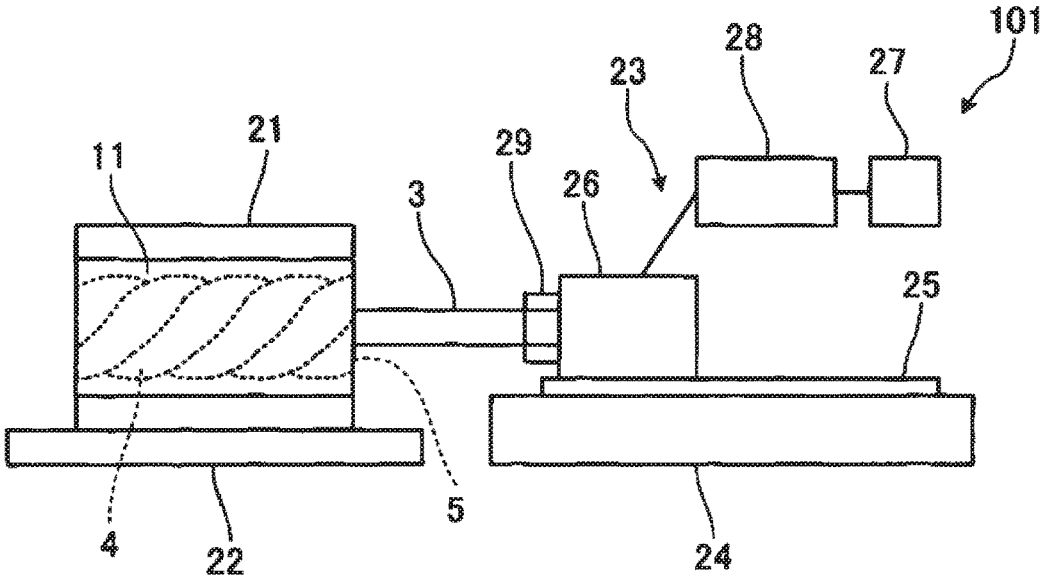
FIG. 6 is a side view of a configuration of a core molding device.

Now, a core molding method according to a second embodiment of the invention is described. Components the same as those described as above are denoted by the same reference numerals and not described in detail. As illustrated in FIG. 6, which is a side view of the configuration, a core molding method according to the second embodiment is different from the core molding method according to the first embodiment in that the core molding method is performed using a core molding device 101. Specifically, in the first embodiment, the core die 4 is manually rotated using the wrench 12 or other devices. In this embodiment, in contrast, the core die 4 is rotated by a rotary driving device 23 included in the core molding device 101.

As illustrated in FIG. 6, the core molding device 101 includes a wooden or metal-made frame 21. The core die 4 having a screw shape is disposed inside the frame 21 and the inside of the frame 21 is filled with self-hardening sand obtained by mixing sand, a resin, and a hardener. The sand, the resin, and the hardener are the same as those according to the first embodiment. An aluminum round bar 3 is attached to a screw portion 5 of the core die 4. The frame 21 is mounted on a stand 22.

Figure 7:
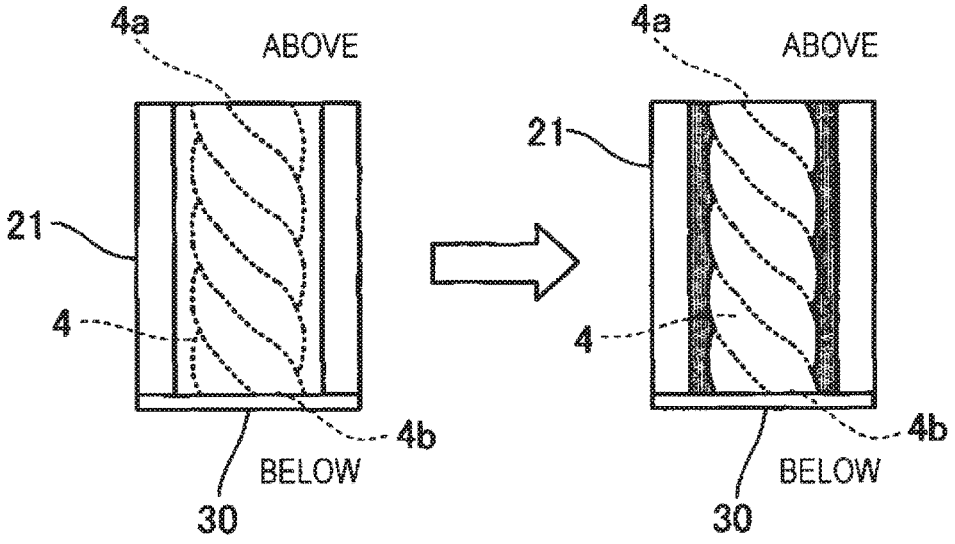
FIG. 7 is a cross-sectional view of a frame.

Here, the self-hardening sand is inserted into the frame 21 in the following manner. As illustrated in FIG. 7, which is a cross-sectional view of the frame 21, the frame 21 is mounted on a stand or the like in such a manner that a first end 4*a* of the core die 4 disposed inside the frame 21 faces up and a second end 4*b* of the core die 4 faces down. Here, the opening on the second end 4*b* of the core die 4 is covered with a board-shaped member 30 so as to prevent the self-hardening sand inserted into the frame 21 from falling down. Thereafter, the self-hardening sand is inserted into the frame 21 through the opening on the first end 4*a* of the core die 4 facing upward. The self-hardening sand is filled into the frame 21 in the axial direction of the core die 4 while being shaken by a hammer hitting each side of the frame 21. The way how the self-hardening sand is mixed and the time for mixing are similar to those in the case of the first embodiment.

Figure 8:
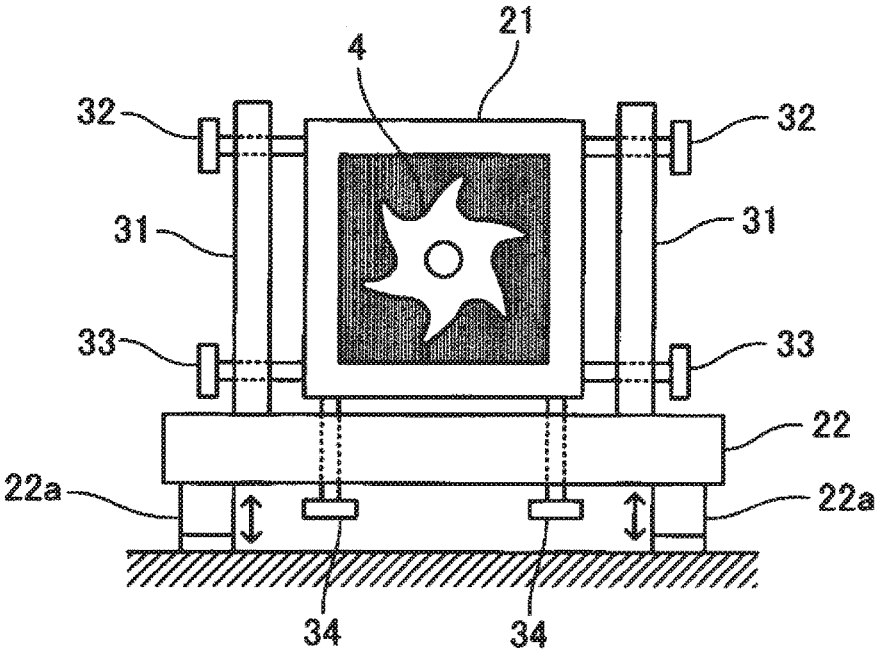
FIG. 8 is a side view of a stand and a frame.

As illustrated in FIG. 8, which is a side view of the stand 22 and the frame 21, the stand 22 on which the frame 21 is mounted has legs 22*a* whose length is variable. In other words, the height of the stand 22 is rendered adjustable. The length of the legs 22*a* may be rendered extendable using a jack structure or extendable by adjusting the degree to which a male screw portion is screwed on a female screw portion. The height of the stand 22 is adjusted so that the rotation axis of a motor 26, described below, and the axis of the core die 4 coincide with each other.

A pair of board members 31 are fixed onto the stand 22. The board members 31 are disposed so as to extend in the axial direction of the core die 4 and face the sides of the frame 21. Multiple screws 32 and multiple screws 33 are screwed on each board member 31 so as to extend in the axial direction of the core die 4, the screws 32 having their ends in contact with an upper end portion of the frame 21, the screws 33 having their ends in contact with a lower end portion of the frame 21. By adjusting the degree to which the screws 32 and 33 are screwed on the board members 31, the position of the frame 21 is rendered laterally adjustable between the paired board members 31.

In addition, multiple screws 34 are screwed on the stand 22 so as to extend in the axial direction of the core die 4, the screws 34 having their ends in contact with the undersurface of the frame 21. By adjusting the degree to which the screws 34 are screwed on the stand 22, the position of the frame 21 is rendered vertically adjustable.

The screws 32, 33, and 34 are adjustment mechanisms that cause the rotation axis of the motor 26 and the axis of the core die 4 to coincide with each other. By causing the rotation axis of the motor 26 and the axis of the core die 4 to coincide with each other, the friction coefficient k of the frictional force exerted between the core and the core die can be minimized when the core die 4 is rotated by the motor 26. Thus, the core die 4 can be stably rotated, whereby the core 11 can be molded while having no internal damage or varying in shape to a lesser extent.

As illustrated in FIG. 6, the core molding device 101 includes a rotary driving device 23. The rotary driving device 23 includes a motor 26, a power source 27, and an inverter 28. The motor 26 is mounted on a stand 24 with a rail 25 interposed therebetween. The rail 25 is laid on the stand 24 in the axial direction of the core die 4. The motor 26 is connected to the round bar 3 with a joint 29 interposed therebetween. Then, when the motor 26 is rotated, the core die 4 is rotated around its axis. The height of the stand 24 on which the motor 26 is mounted is also rendered adjustable in the manner as in the case of the stand 22.

The motor 26 is electrically connected to the power source 27 with the inverter 28 interposed therebetween. The speed of rotation of the motor 26 is adjusted by the inverter 28.

When the core die 4 is manually rotated as in the case of the first embodiment, the axis of the core die 4 is more likely to be inclined and the stress per unit area or the removal torque is more likely to change, whereby stably molding the core 11 is rendered difficult. Rotating the core die 4 using the motor 26, on the other hand, prevents the axis of the core die 4 from being inclined. Thus, the stress per unit area or the removal torque is allowed to be stable, so that the core die 4 is allowed to be stably removed from the core 11.

Here, the maximum torque $T_{moter}$ of the motor 26 satisfies the following relationship:

$$k\sigma\pi D^2 L/2 \leq T_{max} \leq T_{moter} \qquad \text{Formula (8).}$$

Here, as in the case of the first embodiment, k denotes the friction coefficient, D denotes the diameter of a cylinder having a contact area equivalent to the contact area over which the core die 4 and the core 11 touch each other, L denotes the length of the cylinder, σ denotes the stress per unit area produced in the core 11, and $T_{max}$ denotes the maximum torque produced during die removal when the core die 4 is removable from the core 11.

By determining the maximum torque $T_{moter}$ of the motor 26 to be larger than or equal to the maximum torque $T_{max}$ that occurs during die removal when the core die 4 is removable from the core 11, the core die 4 is allowed to preferably rotate around its axis.

When the round bar 3 is rotated by the motor 26, the core die 4 having a screw shape is to move in the axial direction, whereby the motor 26, the core 11, and the core die 4 receive a force in the axial direction. Here, the core 11 would be broken by the force in the axial direction unless the relative distance between the motor 26 and the frame 21 changes.

Figure 9:
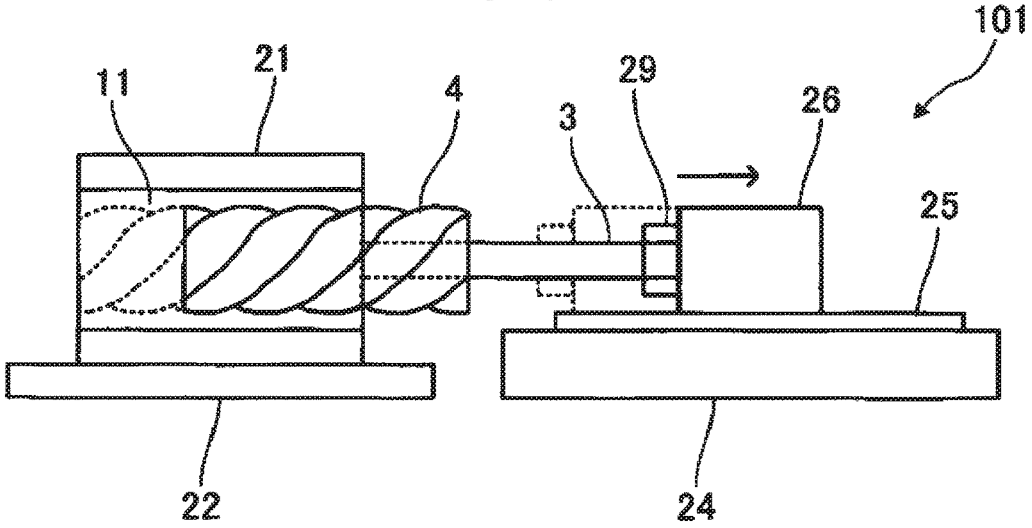
FIG. 9 illustrates a slide movement of a motor.

To address this, the motor 26 is rendered slidable along the rail 25 with the force in the axial direction, as illustrated in FIG. 9, which is a side view. In this embodiment, the motor 26 moves in a direction away from the frame 21. Here, the frame 21 is fixed to the stand 22 using the screws 32, 33, and 34 (see FIG. 8) so as to stay still. Thus, the core die 4 is drawn to the right side of the frame 21 in FIG. 9. Thus, the motor 26 is moved relative to the frame 21, so that the core die 4 is removed from the core 11 without damaging the core 11.

In order to remove the core die 4 from the core 11 throughout the length of the core die 4, the length of the rail 25 is determined to be longer than or equal to a length obtained by adding the full length of the core die 4 to the length of the motor 26 in the axial direction of the core die 4.

The motor 26 may be rendered slidable in such a direction as to approach the frame 21. In this case, the core die 4 is drawn to the left side of the frame 21 in FIG. 9. Here, the round bar 3 is rendered longer than the frame 21 so that the entirety of the core die 4 is removed before the motor 26 comes into contact with the frame 21. Alternatively, the frame 21 may be rendered slidable by being mounted on a rail laid on the stand 22. In this case, the motor 26 is fixed onto the stand 24. The length of the rail laid on the stand 22 is determined to be twice as long or longer than the full length of the core die 4. The direction in which the frame 21 slides may be a direction in which the frame 21 moves closer to or away from the motor 26. When the frame 21 moves so as to come closer to the motor 26, the round bar 3 is rendered longer than the frame 21 so that the entirety of the core die 4 is removed before the frame 21 comes into contact with the motor 26.

The mechanism that slides the motor 26 or the frame 21 is not limited to a rail and may be a wheel provided to the motor 26 or the frame 21. The form of coupling the motor 26 and the round bar 3 together is not limited to a straight form. The motor 26 and the round bar 3 may be coupled in a letter L form using components such as gears. In this case, the motor 26 is fixed onto the stand 24 and the frame 21 slides over the stand 22.

In such a configuration, to mold the core 11, the self-hardening sand acquired by mixing the sand, the resin, and the hardener is first filled into the frame 21, as illustrated in FIG. 7. Then, as illustrated in FIG. 6, the frame 21 is mounted on the stand 22 and the round bar 3 is attached to the screw portion 5 of the core die 4. Thereafter, as illustrated in FIG. 8, the rotation axis of the motor 26 and the axis of the core die 4 are aligned with each other by vertically and laterally adjusting the position of the frame 21. For aligning the axes, a device such as a level is used. When the screws 32, 33, and 34 come into contact with the frame 21, the frame 21 is fixed onto the stand 22.

Thereafter, as illustrated in FIG. 6, the motor 26 and the round bar 3 are coupled with each other using a joint 29. The operation described thus far is performed within an optimized time for hardening the self-hardening sand. Subsequently, the motor 26 is rotated while the maximum torque $T_{moter}$ of the motor 26 is maintained so as to satisfy Formula (8). As illustrated in FIG. 9, the motor 26 thus slides over the rail 25, so that the core die 4 is removed.

Effects

As described above, the core molding device 101 according to this embodiment, the core die 4 is rotated around its axis by the rotary driving device 23. If the core die 4 is manually rotated, the axis of the core die 4 is more likely to be inclined and the stress per unit area or the removal torque is more likely to change, whereby stable molding of the core 11 is rendered difficult. To address this, the core die 4 is rotated by the rotary driving device 23, so that the axis of the core die 4 is prevented from being inclined. Thus, the stress per unit area or the removal torque is allowed to be kept stable, so that the core die 4 can be stably removed from the core 11.

The maximum torque $T_{moter}$ of the motor 26 is determined to be larger than or equal to the maximum torque $T_{max}$ that occurs during die removal when the core die 4 is removable from the core 11. Thus, the core die 4 is allowed to be preferably rotated around its axis.

When the rotation axis of the motor 26 and the axis of the core die 4 are aligned with each other, the friction coefficient k of the frictional force that occurs between the core 11 and the core die 4 can be minimized. Thus, the core die 4 can be stably rotated, whereby the core 11 can be molded while having no internal damage or varying in shape to a lesser extent.

Third Embodiment

Core Molding Device

Figure 10:
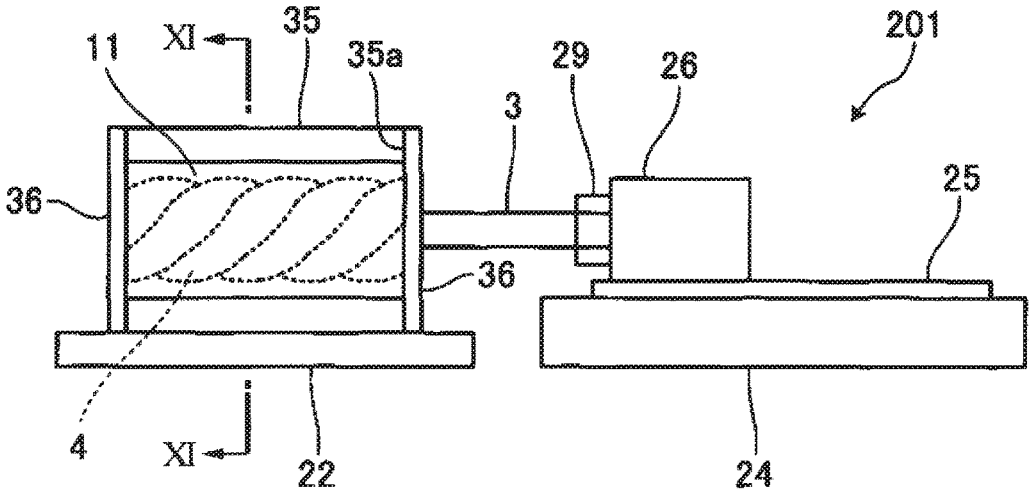
FIG. 10 is a side view of a configuration of a core molding device.

Subsequently, a core molding method according to a third embodiment of the present invention is described. Components the same as those described as above are denoted by the same reference numerals and not described in detail. A core molding device 201 according to the third embodiment, which performs a core molding method, is different from the core molding device 101 according to the second embodiment in that it includes an opening 35*a* in an upper portion of a frame 35, through which the self-hardening sand is inserted, as illustrated in FIG. 10, which is a side view of the configuration.

The core die 4 is disposed inside the frame 35 in such a manner that its axial direction is horizontal. The round bar 3 is attached to the screw portion 5 of the core die 4. Before the self-hardening sand is inserted into the frame 35, the rotation axis of the motor 26 and the axis of the core die 4 are aligned with each other and the motor 26 and the round bar 3 are coupled together using the joint 29.

Figure 11:
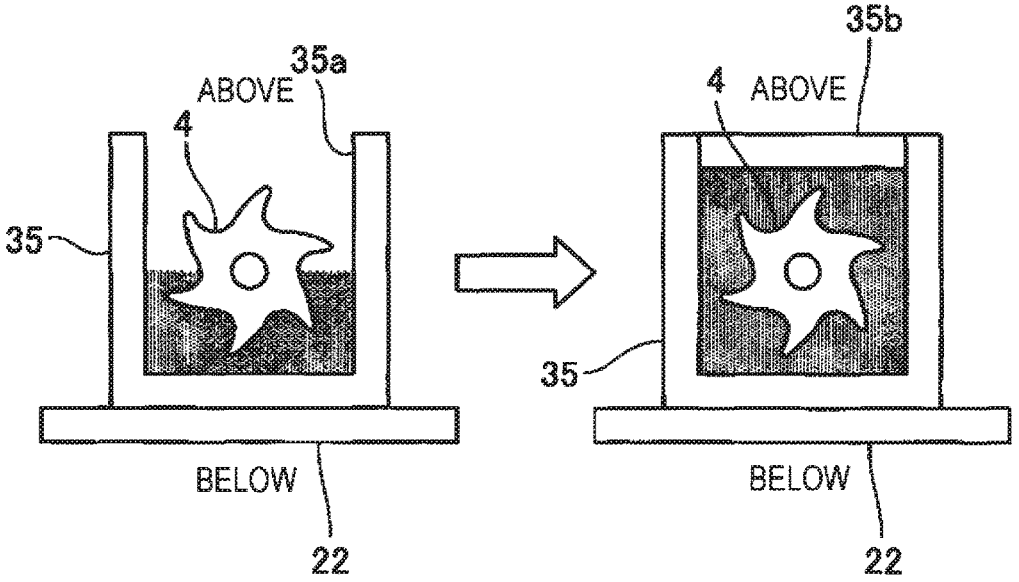
FIG. 11 is a cross-sectional view of the core molding device taken along the line XI-XI in FIG. 10.

In this state, openings of the frame 35 on both ends are covered with a pair of board-shaped members 36. Then, as illustrated in FIG. 11, which is a cross-sectional view of the core molding device 201 taken along the line XI-XI of FIG. 10, the self-hardening sand is inserted into the frame 35 through the upper opening 35*a*. At this time, the self-hardening sand is filled into the frame 35 in the axial direction of the core die 4 while the self-hardening sand is shaken by a hammer hitting each side of the frame 35.

In the second embodiment, the frame 21 into which the self-hardening sand is filled has to be raised with a device such as a crane to be mounted on the stand 22. In this embodiment, in contrast, inserting the self-hardening sand through the upper opening 35*a* of the frame 35 allows the operations from the insertion of the self-hardening sand to the removal of the core die 4 to be performed without moving the frame 35. Thus, the axes of the motor 26 and the core die 4 can be aligned before the self-hardening sand is inserted, whereby the workability is enhanced.

When the self-hardening sand is finished being filled into the frame 35, the opening 35*a* is closed with a lid 35*b*, and the pair of board-shaped members 36 are removed. The operations up to the removal of the board-shaped members 36 are performed within an optimized time for hardening the self-hardening sand. Then, the core die 4 is removed by rotating the motor 26.

Effects

As described above, in the core molding device 201 according to the third embodiment, inserting the self-hardening sand through the upper opening 35*a* of the frame 35 allows the operations from the insertion of the self-hardening sand to the removal of the core die 4 to be performed without moving the frame 35. Thus, the axes of the motor 26 and the core die 4 can be aligned before the self-hardening sand is inserted, whereby the workability is enhanced.

Although some embodiments of the present invention have been described thus far, these embodiments are mere examples and do not particularly limit the invention. Specific configurations or the like may be appropriately designed differently. Operations and effects described in the embodiments of the present invention are mere examples of the most preferable operations and effects arising from the present invention. Operations and effects of the present invention are not limited to those described in the embodiments of the present invention.

The present application is based on Japanese Patent Application No. 2013-252259 filed in the Japan Patent Office on Dec. 5, 2013 and Japanese Patent Application No. 2014-170154 filed in the Japan Patent Office on Aug. 25, 2014, the entire contents of which are incorporated herein by reference.

REFERENCE SIGNS LIST

1 strain gauge
2 thinned portion

3 round bar
4 core die
5 screw portion
6 wooden frame
7 data logger
8 displacement meter
9 end surface
10 personal computer
11 core
12 wrench
21 frame
22 stand
23 rotary driving device
24 stand
25 rail
26 motor
27 power source
28 inverter
29 joint
30 board-shaped member
31 board member
32, 33, 34 screw (adjustment mechanism)
35 frame
35*a* opening
35*b* lid
36 board-shaped member
101, 201 core molding device

The invention claimed is:

1. A core molding method for molding a core having a helical shape using a core die, the method comprising:

a hardening step in which the core die is disposed in a frame and then self-hardening sand acquired by mixing sand, a resin, and a hardener is filled into the frame and left to harden; and a die removal step in which the core die is removed from the core, resulting from hardening of the self-hardening sand, while being rotated around an axis of the core die, wherein, in the die removal step, a time for hardening the self-hardening sand, a frictional force exerted between the core and the core die during die removal, and strength of the core during die removal are optimized wherein the core die is removed from the core while a moment M corresponding to torque and resulting from friction between the core and the core die during die removal is maintained so as to satisfy the following relationship: $0<M=k\sigma\pi D^2L/2\leq T_{max}$, where k denotes a friction coefficient, D denotes a diameter of a cylinder having a contact area equivalent to a contact area over which the core die and the core touch each other, L denotes a length of the cylinder, σ denotes stress per unit area produced in the core, and $T_{max}$ denotes maximum torque produced during die removal when the core die is removable from the core.

2. The core molding method according to claim 1, wherein the core die is removed from the core while stress σ per unit area produced in the core during die removal is maintained so as to satisfy the following relationship:

$$0<\sigma=2hT_{max}/\pi D^2L\leq\sigma_{min},$$

where h denotes a coefficient, $T_{max}$ denotes maximum torque produced during die removal when the core die is removable from the core, D denotes a diameter of a cylinder having a contact area equivalent to a contact area over which the core die and the core touch each other, L denotes a length of the cylinder, and $\sigma_{min}$ denotes minimum compression strength of the core during die removal.

3. The core molding method according to claim 1, wherein the core die is removed from the core while stress σ per unit area produced in the core during die removal is maintained so as to satisfy the following relationship:

$$0<\sigma=2hT_{max}/\pi D^2L\leq\sigma_{min},$$

where h denotes a coefficient, $T_{max}$ denotes maximum torque produced during die removal when the core die is removable from the core, D denotes a diameter of a cylinder having a contact area equivalent to a contact area over which the core die and the core touch each other, L denotes a length of the cylinder, and $\sigma_{min}$ denotes minimum compression strength of the core during die removal.

4. The core molding method according to claim 1, wherein the sand is new sand or reclaimed sand having polygonal or spherical grains, a size of which is 130 AFS or smaller.

5. The core molding method according to claim 1, wherein the resin is an acid-setting furan resin containing furfuryl alcohol and a content of the resin with respect to the sand is 0.8%.

6. The core molding method according to claim 5, wherein the hardener is a hardener acquired by mixing a xylene-sulfonic-acid-based hardener and a sulfuric-acid-based hardener and a content of the hardener with respect to the resin is 40%.

* * * * *